US005152081A

United States Patent [19]

Hallenbeck et al.

[11] Patent Number: 5,152,081

[45] Date of Patent: Oct. 6, 1992

[54] SHOE SOLES HAVING A HONEYCOMB INSERT AND SHOES, PARTICULARLY ATHLETIC OR REHABILITATIVE SHOES, UTILIZING SAME

[75] Inventors: Barry Hallenbeck, Nashua, N.H.; Udo Flemming, Erlangen, Fed. Rep. of Germany

[73] Assignee: PUMA Aktiengesellschaft Rudolf Dassler Sport, Herzogenaurach, Fed. Rep. of Germany

[21] Appl. No.: 364,371

[22] Filed: Jun. 12, 1989

[30] Foreign Application Priority Data

Feb. 3, 1989 [DE] Fed. Rep. of Germany ..... 3903267

[51] Int. Cl.[5] ..... A43B 13/18; A43B 13/20

[52] U.S. Cl. ..... 36/28; 36/114; 36/29

[58] Field of Search ..... 36/27, 28, 29, 30 R, 36/35 B, 114, 71

[56] References Cited

U.S. PATENT DOCUMENTS

| | | | |
|---|---|---|---|
| 532,429 | 1/1895 | Rogers | 36/43 |
| 1,171,879 | 2/1916 | Prenzel | 36/27 |
| 1,559,532 | 10/1925 | Smith | 36/29 |
| 4,342,158 | 8/1982 | McMahon et al. | 36/35 R |
| 4,391,048 | 7/1983 | Lutz | 36/30 R |
| 4,397,674 | 9/1982 | George | 36/126 |
| 4,472,890 | 9/1984 | Gilbert | 36/29 |
| 4,481,727 | 11/1984 | Stubblefield | 36/83 |
| 4,485,568 | 12/1984 | Landi et al. | 36/44 |
| 4,557,060 | 12/1985 | Kawashima | 36/30 R |
| 4,694,591 | 9/1987 | Banich et al. | 36/102 |
| 4,712,314 | 12/1987 | Sigoloff | 36/136 |
| 4,733,483 | 3/1988 | Lin | 36/28 |
| 4,768,295 | 9/1988 | Ito | 36/29 |
| 4,771,554 | 9/1988 | Hannemann | 36/27 |
| 4,774,774 | 10/1988 | Allen, Jr. | 36/28 |
| 4,815,221 | 3/1989 | Diaz | 36/27 |
| 4,817,304 | 4/1989 | Parker et al. | 36/30 R |
| 4,843,735 | 7/1989 | Nakanishi | 36/29 |
| 4,845,863 | 7/1989 | Yung-Mao | 36/30 R |

FOREIGN PATENT DOCUMENTS

| | | | |
|---|---|---|---|
| 3526298 | 1/1987 | Fed. Rep. of Germany | 36/114 |

*Primary Examiner*—Steven N. Meyers

*Attorney, Agent, or Firm*—Sixbey, Friedman, Leedom & Ferguson

[57] ABSTRACT

A shoe, in particular an athletic or rehabilitative shoe having a resilient cushioning sole layer within which at least one insert part made of a honeycomb body of elastically compressible material is embedded with its central axes oriented perpendicular to the plane of the sole and honeycomb body. For improved resilience and energy return, the honeycomb body is made so that even the cells on the periphery of the body are closed in a gastight manner. Furthermore, in accordance with certain embodiments, the honeycomb insert is mounted in the shoe in a manner which permits endwise viewing of the cells of the honeycomb insert, while protecting the honeycomb against damaging ground contact during use. The honeycomb body can be embedded as an insert in a midsole, heel wedge layer, or a removable footbed.

23 Claims, 7 Drawing Sheets

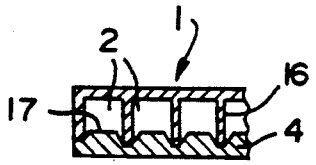
FIG. 9
FIG. 9a FIG. 9b FIG. 9c
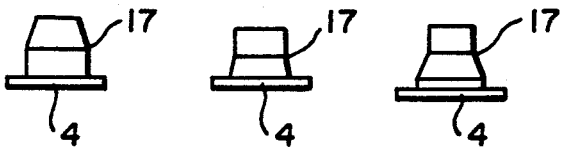
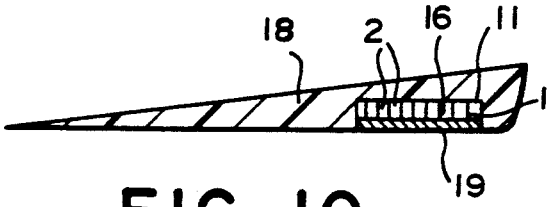
FIG. 10
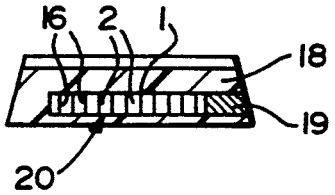
FIG. 11
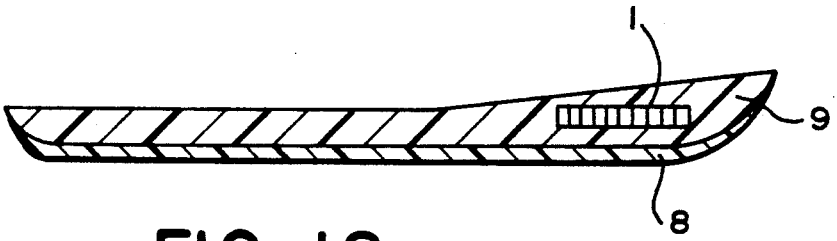
FIG. 12
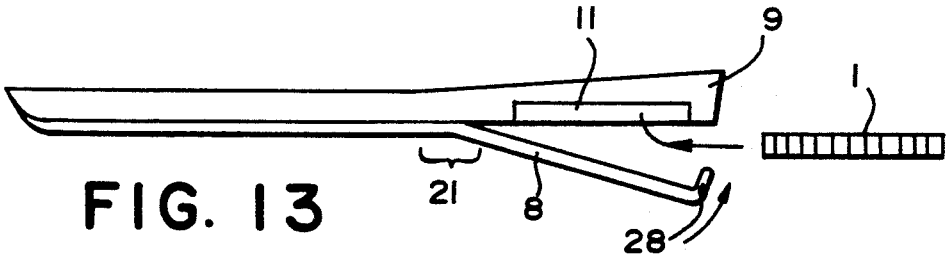
FIG. 13
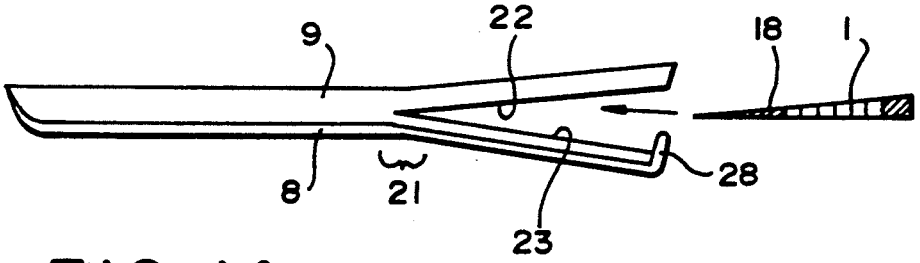
FIG. 14

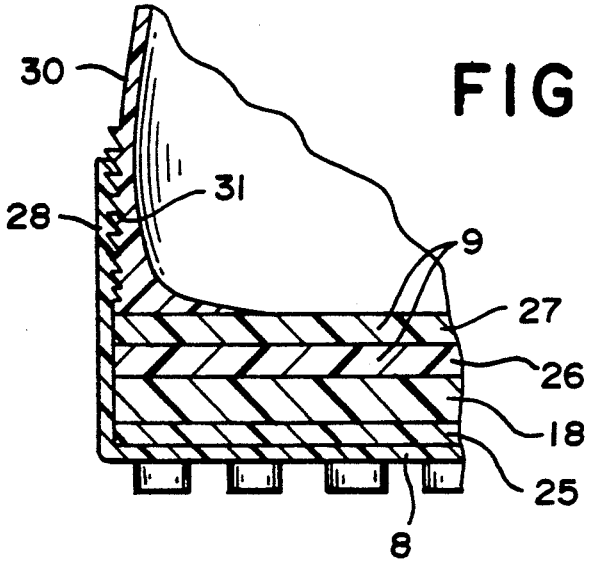
FIG. 17
FIG. 18
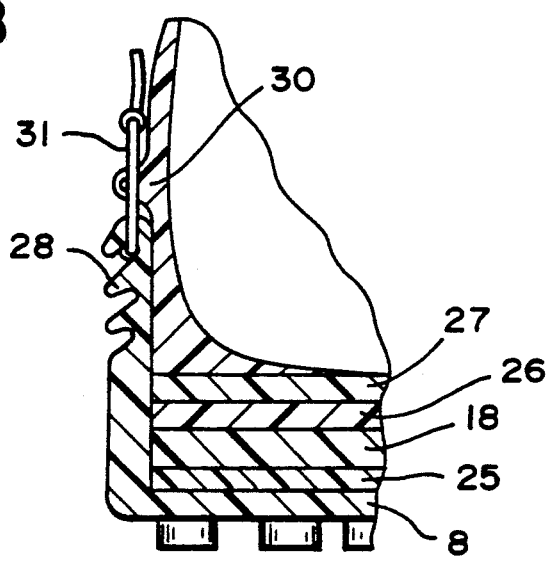
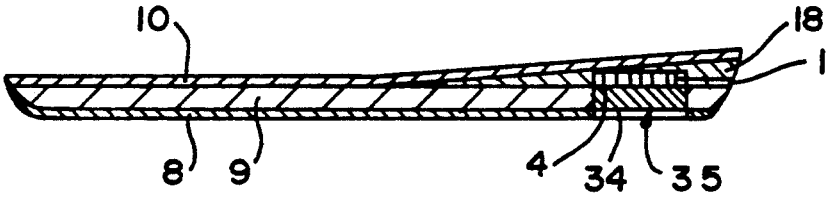
FIG. 19

SHOE SOLES HAVING A HONEYCOMB INSERT AND SHOES, PARTICULARLY ATHLETIC OR REHABILITATIVE SHOES, UTILIZING SAME

FIELD OF THE INVENTION

The present invention relates to shoe soles that are provided with at least one insert part formed of a honeycomb body of elastic, compressible material with gas-filled honeycomb cells, as well as shoes, particularly athletic or rehabilitative shoes which utilize such soles. More particularly, the invention relates to the use of a honeycomb insert wherein the axes of the gas-filled honeycomb cells run approximately perpendicular to the plane of the sole and are confined to localized areas of the sole.

DESCRIPTION OF RELATED ART

In Landi, et al. U.S. Pat. No. 4,485,568, a separate insole for insertion into a shoe is disclosed which has a honeycomb structure incorporated therein. The topside of the insole of this patent is formed of an air-permeable material and the bottom side of a thin backing between which an overexpanded honeycomb structure is disposed. Due to the fact that the honeycomb structure is produced from corrugated or meander-shaped strips that are glued together to produce honeycomb cells of an elongated rectangular shape, the honeycomb cells at the peripheral edge of the insert are laterally open. The illustrated insole of this patent (which is disclosed as being employable as a permanent insole, midsole or outsole) has a shape and size that is designed to cover the entire bottom of the shoe, i.e., extends from the toe to the heel and across the full width of the shoe.

While possibly of minor consequence in the context of the insole as disclosed in Landi, et al. U.S. Pat. No. 4,485,568, such a construction results in the resilience of the honeycomb structure being almost zero at the edge areas as a result of the open cells located there. Furthermore, the presence of perforations in the upper cushion pad for air circulation "prevents the insole from cushioning by compressing air in individual sealed cells." Thus, such a construction must rely upon the depth of the honeycomb to determine the extent to which heel impacts will be cushioned, and, therefore, would have to be thicker than an insole formed of a solid layer of the same material as the resilient honeycomb structure. However, this is an undesirable result from the standpoint of weight, cost, etc. Furthermore, in view of the added cost associated with the use of honeycomb materials, use of such materials over an area coextensive with the entire projected area of the wearer's foot produces an undesirably and unnecessarily high cost factor.

Of course, honeycomb cushioning structures have been incorporated into cushioning soles for shoes for over 90 years and include constructions wherein the honeycomb material is confined to the heel and forefoot or ball area where impacts due to jumping, running, or walking primarily occur. Such constructions include the combined sole and heel of Smith U.S. Pat. No. 1,559,532 and the elastic or anticoncussion heel and sole of Rogers U.S. Pat. No. 532,429. In the case of the Rogers patent, the honeycomb structures made of elastic material are secured to an insole of flexible material and are designed to provide an air cushion which will not collapse altogether under the pressure of a foot compressing the air in each separate cell, but rather the cells with the air inside are intended to support the weight of the foot and yet be sufficiently pliable and cushion-like to prevent jars and concussion to the foot. Similarly, the Smith patent provides an intermediate or midsole wherein soft resilient honeycomb structures are confined to the heel and forefoot regions within pneumatic chambers.

However, even a sealed air cushion honeycomb structure, by itself, of the type disclosed by Smith and Rogers will not provide the degree of cushioning and rebound (resilience) modern runners and other athletes have come to expect in their athletic footwear. Furthermore, there is a significant degree of consumer resistance to paying additional amounts for features that they cannot visually perceive to exist. Thus, the lack of an ability for a consumer to perceive the existence of a honeycomb structure in any of the prior art soles mentioned above makes it difficult for manufacturers to readily market a more expensive product on the basis of its use.

The provision of a window opening in the side of a midsole, which has the effect of exposing an internal viscoelastic unit for attenuating shock and returning energy of foot impact, is disclosed in Parker, et al. U.S. Pat. No. 4,817,304. However, the purpose of the midsole opening is to adjust the impact response of the midsole so that the viscoelastic unit plays a greater role in the impact response than the foam material of the midsole by allowing the side(s) of the air cushion (of which the viscoelastic unit is formed) to flex into and through these openings. Also, such an opening would not be suitable for an embedded honeycomb insert formed of vertically oriented cells in that it can adversely affect performance (or at least would not function as intended) while not clearly displaying the honeycomb nature of the insert, which is only clearly apparent when the cells are viewed endwise.

Of course, shoe sole constructions are known wherein an aperture is provided through the outer sole, thereby rendering the midsole visible from below; see for example, Stubblefield U.S. Pat. No. 4,481,727 and Bunich et al. U.S. Pat. No. 4,694,591. However, such constructions are designed to enable the midsole to deflect, under impact force, downwardly through the outsole. While such an effect may be acceptable and even desirable in the case of solid elastomeric midsoles of the types disclosed by Stubblefield and Banich, et al., it would result in destruction of honeycomb structure as disclosed by Landi, et al., and would open the air cells of Rogers and Smith, thereby preventing a compressible air cushioning effect from being achieved, rendering them ineffective.

With regard to the desire to produce athletic shoe soles which will provide a high degree of shock absorbency and rebound resilience, Allen, Jr. U.S. Pat. No. 4,774,774 discloses the use of a disc spring sole structure formed of a honeycomb framework that spans the width and length of a midsole of a shoe or may be provided in the form of an insole. However, in this case, the cells are open and their axes are oriented horizontally, i.e., parallel to the plane of the sole. While such a construction may provide increased shock absorbency and spring-back resilient action, it does so with a price in the form of decreased lateral stability. Although the biomechanically tuned shoe construction of McMahon, et al. U.S. Pat. No. 4,342,158 may avoid this problem by embedding a single disc or other spring-like structure within the heel of a resilient elastomeric sole, the biomechanically tuned shoe construction of McMahon, et al. is a complicated and expensive design. Furthermore, the existence of the spring-like structure would not be visibly perceivable by a potential purchaser.

Another example of a shoe utilizing a spring arrangement is shown in Diaz U.S. Pat. No. 4,815,221 wherein a spring plate is provided having compressible projections extending therefrom and a stiffening member for directing the release of absorbed energy in a specific direction. Here, again, very sophisticated steps are taken which may have a direct impact upon the cost of the shoe. Even if performance is improved by such efforts, it cannot be experienced in a store. Thus, consumers who are skeptical of claims of improved performance may be hesitant to pay a high price for such a shoe if they have no direct means for perceiving that something special has been done, such as by simply picking up and examining a shoe having such an energy control system in its sole.

Thus, there is still a need for a shoe sole which may be incorporated into a shoe so as to achieve high levels of rebound and cushioning without sacrificing stability and to obtain these characteristics without the incurring added weight or sacrificing durability. Furthermore, it is also highly desirable, from a commercialization standpoint, to produce a sole and shoe possessing these benefits in a manner that will be visually perceivable to consumers.

SUMMARY OF THE INVENTION

In view of the foregoing, it is a primary object of the present invention to provide shoe soles with honeycomb inserts of elastically compressible material which are improved so that, on the one hand, cushioning effects can be increased while, on the other hand, the resilience of the sole in terms of rebound or energy return upon pressure removal from the sole is also enhanced.

In keeping with the preceding general object, it is a further object of the present invention to enable potential purchasers to be able to physically ascertain the presence of the honeycomb body without having to purchase the shoe to physically experience its benefits.

Yet another object is to be able to achieve the foregoing objects along with durability and stability without the expense of added weight and with added costs minimized.

In accordance with various embodiments of the present invention, the foregoing objects and others are achieved through the use of a honeycomb body of elastically compressible material having sealed, gas-filled honeycomb cells whose axes run normal to the plane of the honeycomb body and the plane of a resilient cushioning sole layer of elastomeric material in which it is embedded so as to be peripherally surrounded on all sides. Such a structure can be mounted in a shoe in a manner which permits viewing of the cells of the honeycomb insert, while still protecting the honeycomb against ground contact during use. Furthermore, by closing the honeycomb cells in the edge area, an increased resilience is achieved in the edge area of the honeycomb body, so that the inner area thereof is softer than the edge area, thereby adding an ability to protect against overpronation or oversupponation to the achievement of a high energy return.

By limiting of the honeycomb to the heel or heel and forefoot regions, costs associated with the use of honeycomb materials can be minimized, while obtaining the benefits thereof in the areas most highly stressed by impacts during walking, running, or jumping. Furthermore, by use of the honeycomb body as a localized insert, the stability and energy return benefits associated with the use of a honeycomb structure can be combined with the use of sole layers of elastomeric materials possessing high durability and/or weight reduction characteristics. Additionally, the use of a limited area insert body increases the versatility of the invention, allowing it to be incorporated into midsole or heel wedge layers, or into an inner sole of a shoe.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIGS. 5–9 depict, in cross section, various other constructions of a honeycomb insert body in accordance with the present invention;

Figure 20:
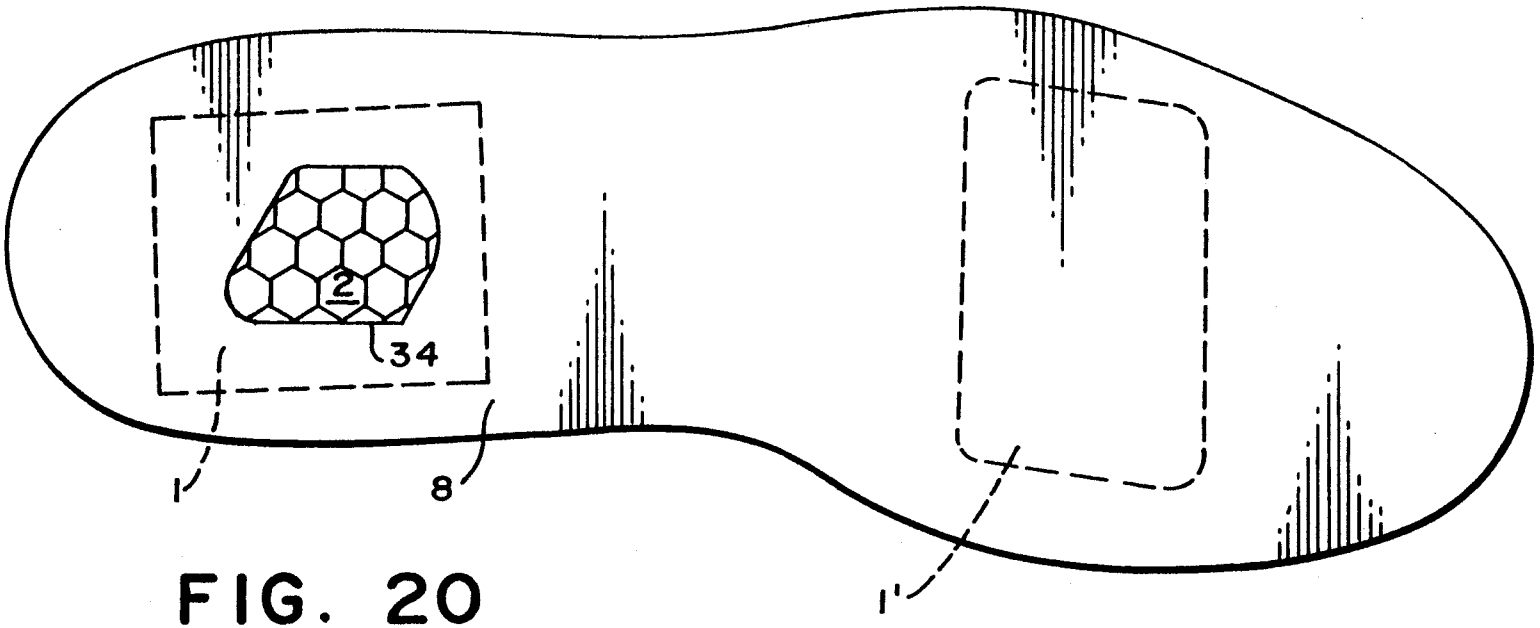
Figure 21:
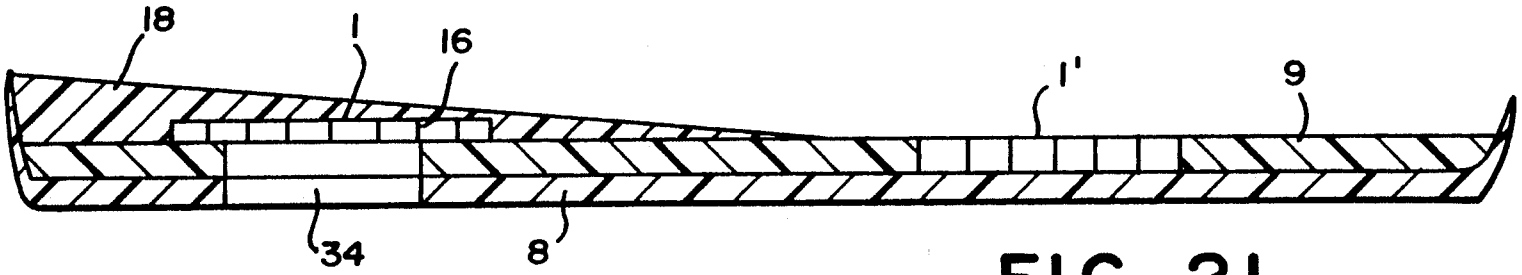
Figure 22:
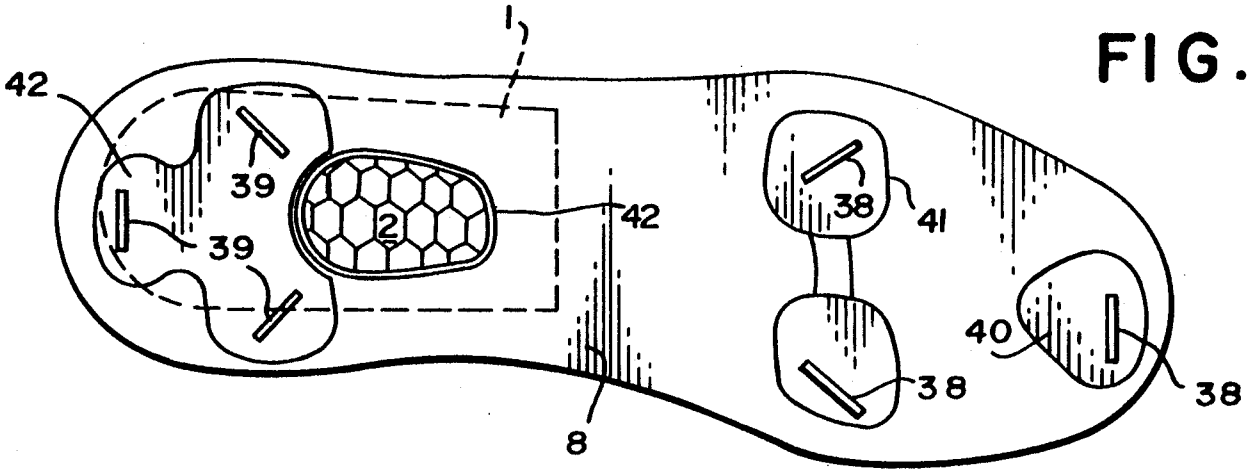
Figure 23:
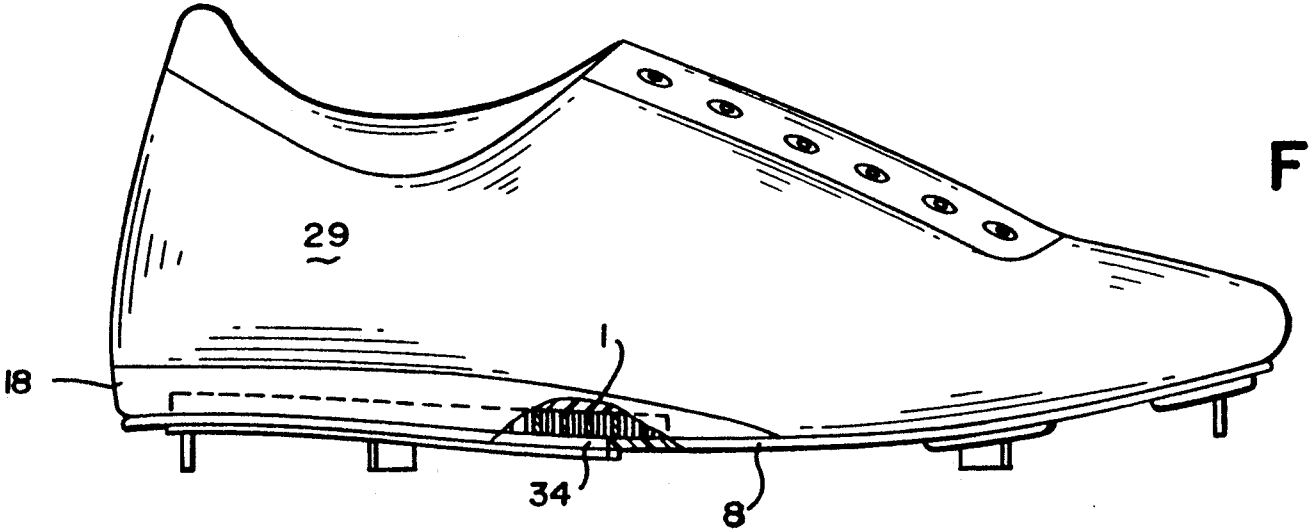
Figure 24:
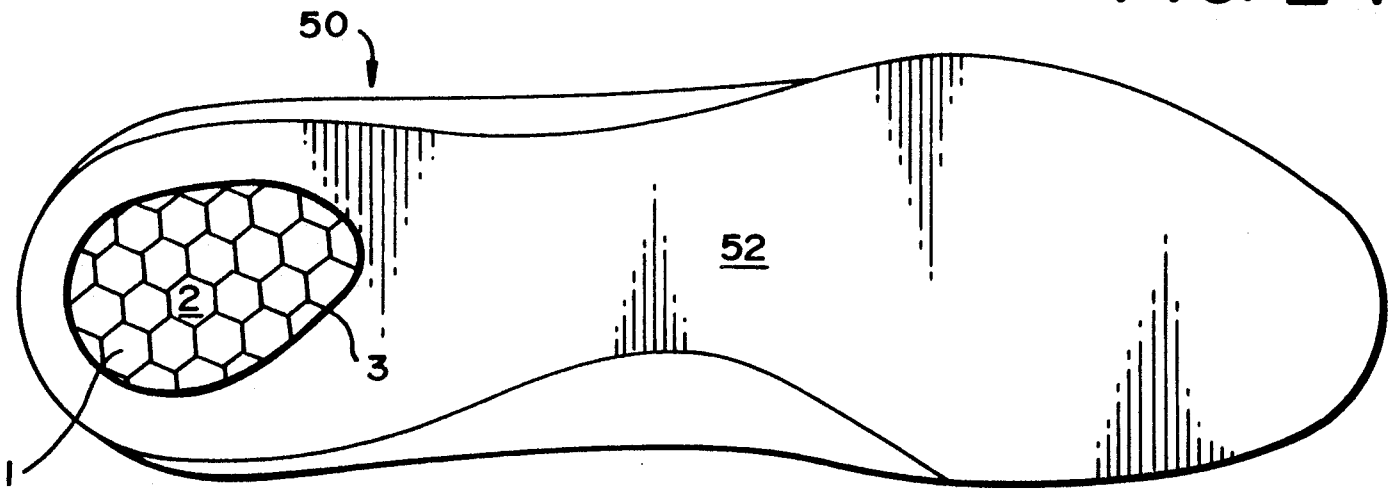
Figure 25:
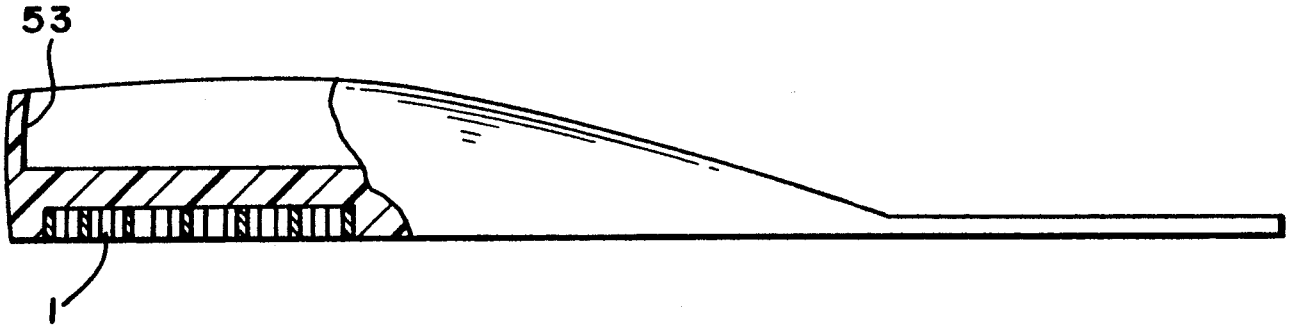

FIGS. *9a–9c* depict modifications for a cover plate of a honeycomb insert body in accordance with the FIG. 9 embodiment;

FIG. 10 is a cross-sectional view of a heel wedge of a shoe sole in accordance with the present invention;

FIG. 11 is a transverse cross-sectional view of a midsole with an insertable honeycomb body therein;

FIG. 12 is a longitudinal sectional view of a shoe sole having a honeycomb body embedded in the sole by the molding of a midsole thereabout;

FIGS. 13–18 illustrate embodiments wherein a shoe has a downwardly swingable outer sole portion for selective mounting of honeycomb inserts;

FIG. 19 is a longitudinal cross-sectional view through another embodiment of a sole in accordance with the present invention wherein a window opening is provided at the underside of the sole;

FIGS. 20 and 21 show modifications to the FIG. 19 embodiment wherein the window opening extends through to the honeycomb insert body, in bottom plan and partially broken away side elevational views, respectively;

FIGS. 22 and 23 are views similar to FIGS. 20 and 21, but of a cleated shoe embodiment; and FIGS. 24 and 25 are bottom plan and partially broken away side elevational views, respectively, of a removable footbed in accordance with the present invention.

DETAILED DESCRIPTION OF THE PREFERRED EMBODIMENTS

Figure 1:
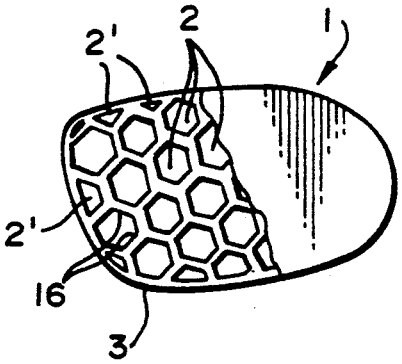
FIG. 1 is a partially broken away top view of a honeycomb body for a shoe according to the present invention.

In FIG. 1, a honeycomb body is designated, generally, by the numeral 1 and is formed as an injection molded part made of an elastically compressible material; in particular, a plastic such as polyurethane, polyolefin, polyethylene, polypropylene, polybutane, polyamide, ethylene-vinyl-acetate, and combinations thereof or the like. The above-mentioned plastics, preferably, are not foamed plastics. Individual honeycomb cells 2 have a polygonal cross section, preferably of a hexagonal shape. However, nonpolygonal shapes, for example circular, elliptical, or other rounded shapes may be given to the cells 2. The honeycomb body has an encircling edge 3 that seals edge cells 2' in a laterally outward direction, closing what would otherwise be laterally open partial cells.

Figure 2:
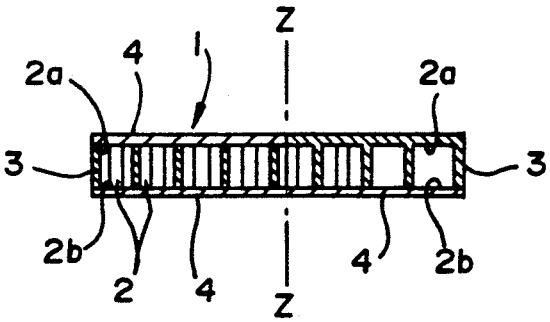
FIG. 2 shows the honeycomb body according to FIG. 1 in a longitudinal sectional view, the construction to the right of line Z—Z being modified relative to that on the left.

In order to render the cells 2, 2' of the honeycomb body 1 gastight, cover sheets 4 extend across the top and bottom of the honeycomb body. These cover sheets may be separate, thin flexible sheets that are connected at the top and bottom sides 2*a*, 2*b* of the honeycomb insert 2, by an adhesive, welding, or other form of bonding. Alternatively, as reflected by the right-hand side of FIG. 2, one of the cover sheets, for example the top one, can be produced during injection molding of the honeycomb body so as to be an integral part thereof. In the latter case, then, only the underside of the honeycomb cells needs to be sealed by a separate cover element in the noted manner.

The height of the honeycomb body 1 is preferably 0.3 cm to 1.5 cm, in particular 0.5 cm to 1.0 cm, and is preferably of a constant height throughout the entire extent of the honeycomb body. However, as is shown with respect to later described embodiments, it may also be made of a wedge-like tapering shape, for example for use in a heel wedge layer.

Figure 3:
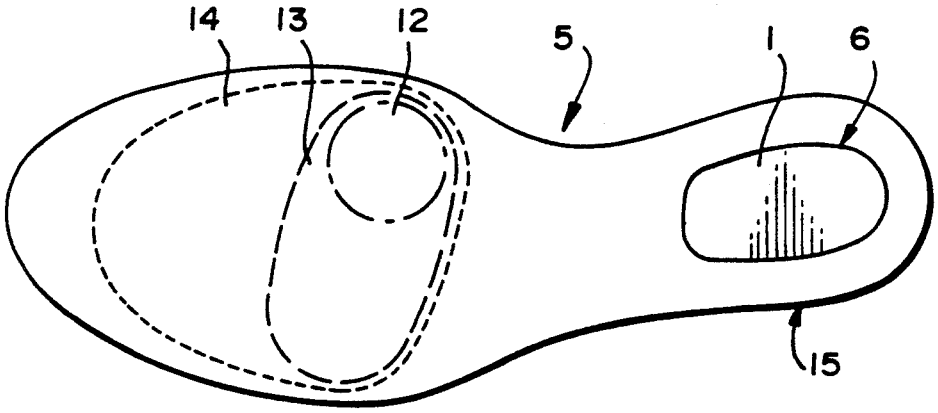
FIG. 3 is a bottom plan view of a shoe sole upon which the areas at which honeycomb bodies may be incorporated are depicted.
Figure 4:
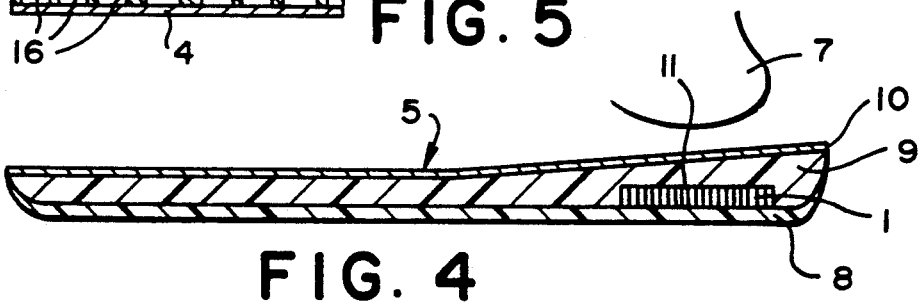
FIG. 4 is a longitudinal cross-sectional view of a shoe sole with a single honeycomb insert in accordance with the present invention.

As reflected by FIGS. 3 and 4, the honeycomb body 1 is utilized as an insert that is embodied in a shoe sole 5, in a central area 6 corresponding to the location of the heel bone 7 of a wearer of a shoe incorporating such a sole. Thus, honeycomb body 1 does not extend fully across the sole, but rather is peripherally surrounded by the material of the sole so as to be at least 0.5 cm to 2 cm from the peripheral edge 15 of the heel area of shoe sole 5. The honeycomb body 1 may be fixed in position within the central area 6 by adhesive bonding or a frictional fit, for example.

The attachment of honeycomb body 1, in area 6 of heel bone 7, offers the advantage that the heel bone 7 acts directly or indirectly upon the honeycomb body 1, leading to a good cushioning effect and to a desired energy return (resilience) upon lift-off of the shoe sole. In the embodiment according to FIG. 4, the shoe sole 5 has a wear-resistant outsole 8, a cushioning midsole 9 and an insole 10. Honeycomb body 1 is shown embedded within a recess 11 formed at the lower side of the midsole 9, which may be formed of a light-weight resilient cushioning material, such as ethylene-vinyl-acetate, or a durable resilient cushioning material, such as polyurethane, for example.

In addition to the honeycomb body 1, provided in area 6 of the shoe sole 5, a second honeycomb body may be inserted into the sole at an area 12 (dot-dash line) corresponding to the ball of the big toe, or in an area 13 (broken line) corresponding to the ball of the foot, or an area 14 (dotted line) correponding to the forefoot area. In this way, good cushioning resilience properties are achieved in these areas along with lateral stability, which can be attributed to the honeycomb structure as well as the gas cushion produced by the air-tight honeycomb cells 2, 2'. In this regard, the gas pressure in the honeycomb cells 2, 2' can function most advantageously when the pressure therein is greater than atmospheric, for example between 1000 hPa and 3000 hPa, in particular to 1500 hPa.

Figure 5:
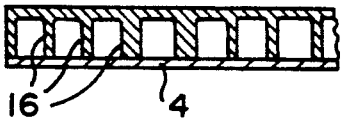
Figure 6:
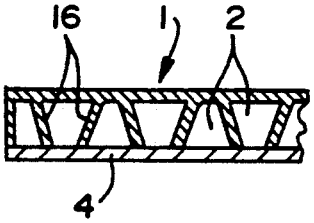
Figure 7:
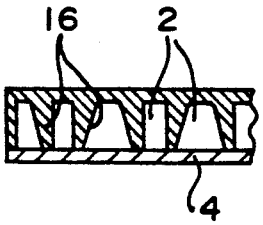
Figure 8:
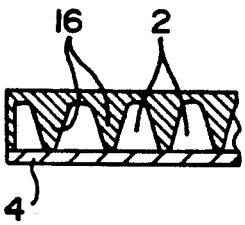
Figure 15:
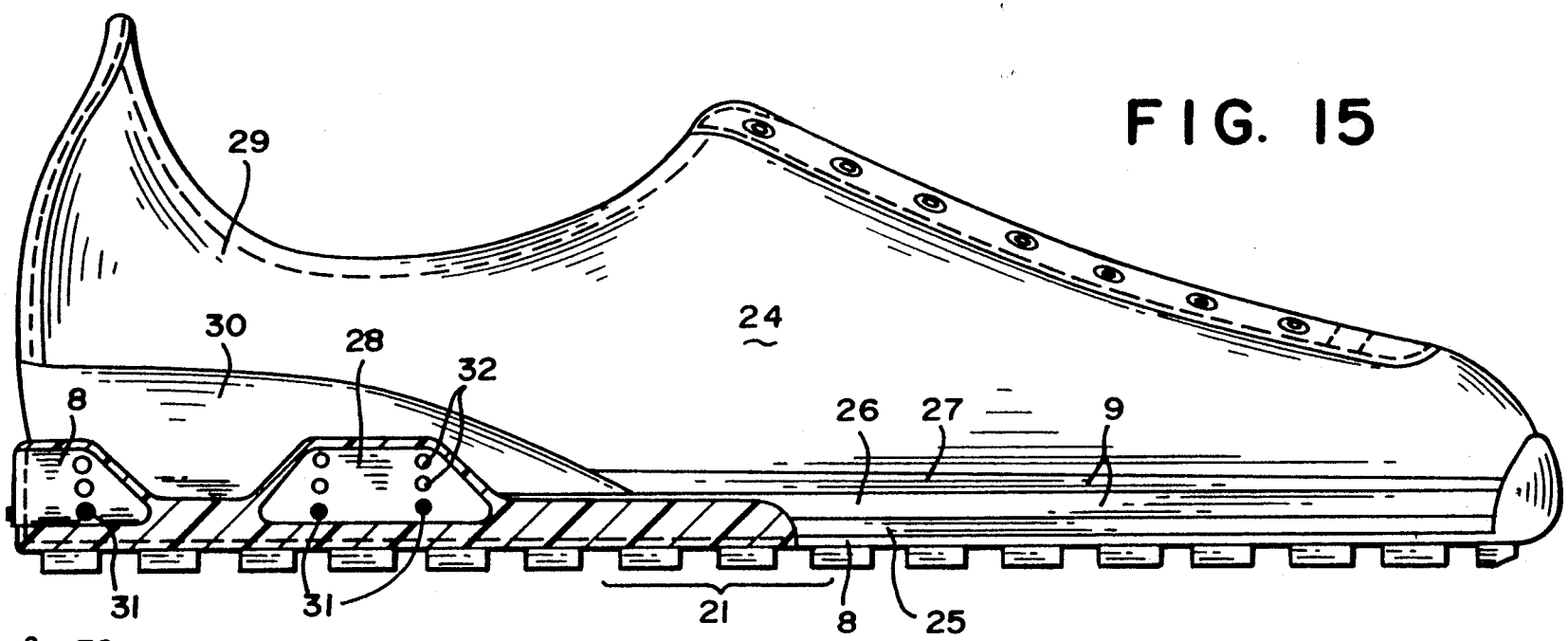
Figure 16:
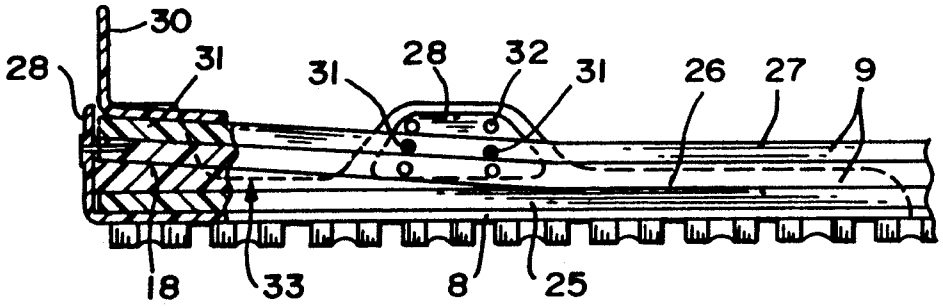

Additional control over the cushioning and resilience properties of the honeycomb body 1 can be achieved by regulating the thickness of the walls 16 which define the cells 2, 2' of the honeycomb body 1. In particular, it is possible to make the honeycomb wall 16 vary in thickness in different areas of the body 1, such as shown in FIG. 5. Another possibility for varying the performance characteristics is to make the honeycomb cells 2, 2' frustoconical in cross section (FIGS. 6 and 7) and/or to make the walls 16 frustoconical in cross section (FIGS. 7 and 8).

While it is preferred that the cover sheets 4 are made of thin flexible plastic, as already noted, the cover sheets 4 may be in the form of a plate-like lid having projections 17 that are designed to engage in the honeycomb cells 2, 2'. With such a configuration (see FIGS. 9, 9*a*–9*c*), by pressing such a lid onto the open side(s) of the honeycomb body 1, so as to forcefit engage the projections within the cell openings, a gastight sealing and connection of the cover sheet 4 can be achieved. Of course, gluing or welding can also be used with such embodiments, as well. To facilitate insertion of the projection 17, they are, preferably, made so as to be inclined or tapered. The height of projection 17, preferably, is between 1 mm and a maximum of 4 mm, so as to fill less than half of the height of the cells within which they engage.

For shoes which utilize a heel wedge 18 as its midsole or a layer of the midsole, the honeycomb body 1 can be embedded within the heel wedge 18. In FIG. 10 a honeycomb body 1 is shown enclosed within a recess 11 of a heel wedge 18, and is covered from below, for example, by a cover plate 19. The cover plate 19 is formed of an elastic material having a shore A hardness of between 40 and 80, and is held in the recess 11 by a friction fit and/or by being glued in. Alternatively, the honeycomb body 1 may be inserted into a slot-like recess 20 which opens to the side of the heel wedge 18, instead of below, a plug-like cover element 19 holding it in place as shown in FIG. 11.

However, preferably, the honeycomb body 1 is embedded in the material of the heel wedge 18 or of midsole 9 during molding thereof, for example by casting or injection molding. In FIG. 12 the honeycomb body 1 is shown completely surrounded by the material of the midsole 9. In the case of this illustrated midsole, a heel wedge layer is integrally formed therewith.

According to another advantageous embodiment of the invention represented in FIG. 13, the sole can be provided with an outsole 8 that is downwardly swingable approximately from an arch area 21 rearwardly to the heel as a means for enabling exchangeable insertion of honeycomb bodies of varying properties. In such a case, the honeycomb body 1 can be inserted into a downwardly open recess of the midsole 9 that is exposed by the downward swinging of the outsole 8. After insertion of the honeycomb body 1, the outer sole part is then swung upward and reattached to the fixed part of the sole or the heel of the shoe upper. Alternatively, as shown from FIG. 14, the honeycomb body can be part of a heel wedge layer insert that can be inserted between the facing surfaces 22 and 23 of fixed and swingable portions of the midsole 9, respectively.

In FIGS. 15–18, details of a shoe 24, for example an athletic or rehabilitative shoe, are shown. In this regard, although only a low top shoe is represented, the shoe can be a high top shoe of the type utilized for basketball or a boot-type shoe. However, it is noted that, apart from the use of a honeycomb body as an insert layer, this shoe construction corresponds to that disclosed in commonly assigned U.S. patent application Ser. No. 255,484, filed Oct. 11, 1988 now U.S. Pat. No. 4,942,077.

Shoe 24 has a sole composed of an outsole 8, which can have a cushioning layer 25 affixed thereto, and a midsole 9 comprised of one or more layers 26, 27.

The sole is constructed so that the outsole 8 can be separated from the midsole 9, at least from about the arch joint area 21 to the heel. The attachment of the outsole 8 in the separable area thereof is performed by attachment means 28 that can be in the form of tabs that extend upwardly from the outsole and have apertures through which pins 31 may be passed into engagement with the midsole 9 and/or upper 29 (see FIGS. 15 and 16). Instead of individual tabs, the outsole 8 can have a shell shape in which the whole edge thereof projects upwardly.

Instead of producing the securement by pins 31 and holes 32, the attachment means 28 could be in the form of sawtooth formations on the facing surfaces of the tabs 31 and heel counter 30 (FIG. 17) or hook-like formations that are engaged by a lever fastener (FIG. 18).

It should be readily apparent that the above arrangements enable a multiplicity of possibilities to be achieved for matching the height of the shoe in the heel area and/or the cushioning characteristics of the sole via the insertion of parts of varying heights and/or properties into the shoe, even varying same for one shoe of a pair, relative to the other, in any of the ways described in connection with the noted copending application Ser. No. 225,484. Accordingly, this application is hereby incorporated by reference to the extent necessary to complete a full understanding of this aspect of the present invention.

Furthermore, it should be apparent that these embodiments enable a honeycomb body to be selected so as to match the characteristics of the shoe to the weight of the person wearing it. Thus, for example, a person weighing up to 60 kg would find it suitable to select a honeycomb body having an average hardness of about 25 shore A, while a person of up to 70 kg might find a shore A average hardness of 35 more suitable, and a person weighing up to 80 kg or more might prefer an average shore A hardness of 45. It is noted that the term "average shore A hardness" is used since it should be appreciated that due to the nature of the honeycomb body, which is composed of walls and air cells, a specific hardness will not actually be experienced even though the material of which the honeycomb body 1 is made may have a specific hardness of 25, 35 or 45 shore A.

While all of the above described embodiments are fully satisfactory from a functional standpoint, as pointed out in the "Background" portion of this application, in order to produce a commercially successful product, the mere incorporation of technological improvements is often insufficient to enable the product to be successfully marketed, particularly if increased costs are associate-d with the improvements. Thus, it is desirable to produce a shoe of the aforementioned type wherein the advantageous honeycomb insert can be viewed by a potential purchaser (as is the case for a selectively insertable or removably honeycomb body insert of the just-described shoe with a downwardly swingable sole) in order to influence his decision to purchase the shoe under circumstances within a store which preclude physically perceiving the performance characteristics that will be experienced through use. With this in mind, the following embodiments will be described, keeping in mind that any of the ancillary characteristics described with respect to the preceding embodiments, such as the constructional features of the honeycomb body 1, will apply.

In accordance with the embodiment of FIG. 19, the outer sole 8 is provided with a window opening 34 below the central heel area 6 shown in FIG. 3. A honeycomb body 1 is inserted in the midsole 9, in particular in a heel wedge layer 18 thereof. To prevent damaging ground contact with the honeycomb body 1, a protective plate 35 is secured in the midsole 9 between the window opening 34 and the honeycomb body 1. Thus, by making the cover sheet 4 and the protective plate 35 of transparent or highly translucent material, a perspective purchaser can visibly perceive the existence of the honeycomb body within the sole simply by looking at it, despite the fact that the honeycomb body is embedded deeply within the sole structure.

However, as can be seen with reference to FIGS. 20 and 21, it is possible for the window opening 34 to not only extend through the outsole 8, but through the midsole layer 9 as well, in order to permit endwise viewing of the cells 2 of the honeycomb body 1 that is embedded as an insert within the midsole heel wedge layer 18. In such a case, the window 34 should be appreciably smaller in area than the honeycomb body 1 (see FIG. 20 for example). In particular, in order to prevent damage to the honeycomb body and to produce the desired cushioning effect through collapsing of the cells 2, it is important to ensure that the honeycomb will resiliently collapse under heel loading and not deflect into the window 34. In this regard, it has been found that a considerable degree of liberty can be taken in the configuring of the window 34 (note the irregular configuration illustrated in FIG. 20), so long as the window is no larger than approximately 3–5 cells across in the widthwise direction across the shoe.

A shoe possessing an excellent combination of properties for production of this embodiment is obtained by utilizing an EVA material for production of the midsole layer 9, in order to minimize the weight of the sole, and a polyurethane heel wedge area 18 for added durability. A high degree of shock absorption and energy return is obtained by the provision of the honeycomb body 1 without sacrificing lateral stability and longitudinal flexibility, if it is formed of a polyurethane-"PVEX" mixture (PVEX is a trademark for a polyamide plastic formed of a polyether-block amide) and if the cells have a distance between oppositely facing walls of approximately 5–8 mm and a similar height. Furthermore, optionally, a second honeycomb body 1' can be inserted into the midsole layer 9 in the region of the ball of the foot, as shown. However, in such a case, no window would be provided below the additional honeycomb body; although the outsole 8 could be made of a translucent or transparent material in an underlying region, if so desired.

While the embodiment of FIGS. 20 and 21 are particularly suitable for use in court shoes, such as tennis and basketball shoes, as well as running shoes, it is not particularly well suited for cleated shoes which normally confine any elastic cushioning sole layers to an area extending rearwardly from a point just behind the ball of the foot, by utilizing only a heel wedge midsole. However, an embodiment specifically designed for cleated shoes is shown in FIGS. 22 and 23.

As can be seen from FIG. 22, the outsole 8 of this embodiment has a first grouping of cleats 38 in the forefoot region of the shoe and a second grouping of cleats 39 in the heel area. Surrounding the points at which the cleats 38, 39 project from the outsole 8, the outer sole is provided with thickened reinforcement areas 40, 41 and 42. In this regard, the particular pattern, type and number of cleats illustrated are typical of a baseball shoe, and of course may be varied, the same being true for the configuration of the reinforcements.

As can be seen in FIG. 23, a wedge-shaped midsole or heel wedge 18 extends rearwardly from just behind the ball of the foot in overlying relationship to the outsole 8. Embedded as an insert within this heel wedge 18 is a honeycomb body 1 that extends from the central heel area into the central arch area. In this case, the honeycomb body rests directly on the upper side of the outsole 8. Thus, to permit endwise viewing of the cells 2 of the honeycomb body while protecting it from deflection through the window 34, the window 34 must be placed in a substantially nonload bearing area, such as under the central arch area of the foot. Furthermore, further protection can be afforded by placing a raised reinforcement 42 surrounding the window opening 34. Additionally, it is preferable if the width of the opening 34 is less than that of the spacing between the medial and lateral side cleats 39 and is in proximity to the reinforcement 42 of the heel area grouping of cleats, since this leads to a minimum weakening of the sole.

As will be appreciated, embodiments such as those of FIGS. 20, 21 and FIGS. 22, 23 require incorporation of the honeycomb body into a shoe during its initial manufacturing stages. The embodiment of FIGS. 24 and 25 illustrate an embodiment which enables the invention to be applied to finished, otherwise conventional athletic or rehabilitative shoes in that it is in the form of a footbed 50 that may removably be positioned within the shoe upper, for example directly on top of the insole board. This footbed 50 is in the form of a resilient cushioning sole layer formed, for example, of polyurethane, the inner surface 53 of which may be covered with a terry cloth-like sock liner material. The shape of footbed 50 conforms essentially with that of known footbeds except that its bottom wall thickens from a point rearwardly of the ball of the foot towards the heel somewhat more than normal so as to be approximately a centimeter thick at the end of the heel.

Embedded within the central heel area of the cushioning sole layer 52 is a honeycomb body 1. Advantageously, this honeycomb body is incorporated into the footbed during molding of the cushioning sole layer 52. Furthermore, as can be seen from FIG. 24, in view of the fact that greater heel impact loading occurs at the lateral (outer) side of the foot than at the medial (inner) side, the honeycomb body can have an assymetric shape that is longer at the lateral side than at the medial side.

When such a footbed 50 is sold as an individual item, the presence of the honeycomb is readily apparent, and when sold as part of a shoe, endwise viewing of the cells of the honeycomb body is still possible simply by lifting out the removable footbed 50 from within the shoe upper. Thus, this embodiment also enables the benefits of the present invention to be achieved while facilitating marketing thereof.

It should be appreciated that various features from amongst the described embodiments can be interchanged with each other, with the basic constant being the use of a honeycomb body 1 that is formed with air cushion, gastight cells, including those cells or partial cells disposed on the periphery of the honeycomb body, preferably as an injection molded or cast part that can be simply and easily incorporated into a sole element as an insert. The honeycomb cells, while shown of a polygonal design, may be round or elliptically shaped, instead. In the case of polygonal sides, the distance between oppositely facing walls should be in the range of 3 mm to 15 mm and with round or elliptically-shaped cells, the diameter or large elliptical axis would be of said 3 to 5 mm range; although, in the case of the embodiments of FIGS. 20–23, it is preferable to limit the maximum size of the cells as indicated above.

On the other hand, while all of the above embodiments have been described as having sealed gas-filled cells 2 forming a gastight air cushion, it is not mandatory that the gas-filled cells be sealed so as to be gastight under all circumstances. For example, the honeycomb body 1 may be sealed as a whole, while each individual cell might not, thereby allowing gas to flow between cells 2 but not out of the honeycomb body. Still further, one or both ends of some or all cells 2 may be allowed to experience a controlled air leakage out of the honeycomb body 1 for controllably reducing the firmness of the honeycomb body 1, particularly when it is formed of firmer and more resilient materials, or for producing a degree of ventilation. In fact, while not currently preferred, where the honeycomb body 1 is constructed to possess sufficient resilience and impact absorbance characteristics by itself (such as through material selection and physical construction; using cell walls as in FIGS. 6–8, for example), it may be possible to leave one or both sides of the honeycomb body totally open, i.e., to eliminate one or both cover sheets 4.

Thus, while we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. An athletic shoe having an upper, a resilient cushioning sole layer and a wear resistant outsole, wherein said resilient cushioning sole layer is formed of a resiliently compressible elastomeric material, conforms in area to that of at least that portion of the shoe which extends rearwardly from approximately an arch area, and contains an elastically compressible, laterally stable, planar honeycomb insert having gas-filled cells, central axes of which are oriented normal to the plane of the insert; wherein said honeycomb insert is embedded within the elastomeric material at least in a central heel area of the shoe; and wherein said honeycomb insert is mounted in said shoe in a manner which permits endwise viewing of the cells of the honeycomb insert while protecting the honeycomb insert against damaging ground contact during use.

2. An athletic shoe according to claim 1, wherein said resilient cushioning sole layer is part of a resiliently compressible midsole of the shoe, and wherein window opening means for exposing said honeycomb insert extends vertically through at least said outsole, said honeycomb insert being supported so as to be restrained from deflection through said window opening means.

3. An athletic shoe according to claim 2, wherein said midsole comprises a midsole layer extending the length and width of the shoe and a heel wedge layer extending rearwardly from approximately the arch area; wherein said insert is embedded in said heel wedge; wherein said window opening means extends through said midsole layer in addition to said outer sole; and wherein said window opening means is smaller in area than said honeycomb insert, being sufficiently small to ensure adequate support for said honeycomb insert from below to restrain deflection of the honeycomb insert through the window opening means.

4. An athletic shoe according to claim 3, wherein said midsole layer is formed of ethylene-vinyl-acetate, said heel wedge is formed of polyurethane, and said honeycomb insert is formed of a material from the group consisting of polyethylene, polypropylene, polyamide, polyurethane, and mixtures thereof.

5. An athletic shoe according to claim 3, wherein said window opening means has a width corresponding to that of approximately 3–5 of said gas-filled cells.

6. An athletic shoe according to claim 3, wherein said heel wedge encases said honeycomb insert only at top and peripheral sides thereof.

7. An athletic shoe according to claim 2, wherein said outsole has cleats on an underside thereof, wherein said midsole is wedge-shaped extending rearwardly from just behind the ball of the foot in overlying relationship to said outsole; wherein said honeycomb insert extends from said central heel area into a central arch area; and wherein said window opening means is confined to said central arch area.

8. An athletic shoe according to claim 7, wherein a raised reinforcement extends about said window opening means on the underside of the outsole.

9. An athletic shoe according to claim 7, wherein said cleats are confined to a first grouping at a forefoot region of the shoe and a second grouping in the heel area of the shoe; wherein said window opening means is situated in proximity to said second grouping and has a width that is less than that of a spacing between a medial side cleat and a lateral side cleat of said second grouping.

10. An athletic shoe according to claim 7, wherein said wedge-shaped midsole encases said honeycomb insert at only top and peripheral sides thereof.

11. An athletic shoe according to claim 1, wherein said resilient cushioning sole layer is a midsole, said honeycomb insert being confined to a heel area of the midsole and being encased thereby at top and peripheral sides but being exposed at a bottom side of the midsole, a window being provided in a heel area of an outsole of the shoe for viewing of a portion of said exposed bottom side of the honeycomb insert.

12. An athletic shoe according to claim 1, wherein said honeycomb insert is sealed so as to be substantially gastight.

13. An athletic shoe according to claim 12, wherein the honeycomb insert is sealed at each of opposite sides by a flexible sheet that overlies axial ends of the gas-filled cells.

14. Shoe, in particular an athletic or rehabilitation shoe, with a shoe sole with at least one insert part formed of a planar honeycomb body of elastically compressible material, having gas-filled honeycomb cells with central axes that run at least approximately central axes that run at least approximately perpendicular to the plane of the insert part, the honeycomb body being made as a self-contained unit having a molded body in which the honeycomb cells are sealed at the periphery of the honeycomb body as well as at upper and lower honeycomb cell openings, and wherein said at least one insert part is located within a cushioning sole layer that is connected to an outsole of the shoe; and wherein the shoe sole comprises the outsole, a midsole and an insole; and wherein the cushion sole layer in which the honeycomb body is located is said midsole; and wherein the outer sole has a window below the honeycomb body in a heel area and a cover element of elastic material is disposed on the underside of the honeycomb body.

15. Shoe according to claim 14, wherein an underside of the cover element is recessed within the sole above the outsole.

16. Shoe according to claim 15, wherein the cover element is formed of a translucent or transparent material.

17. Shoe sole comprising a resilient cushioning sole layer formed of a resiliently compressible elastomeric material conforming in area to the projection of a foot from approximately an arch area to the rear of the heel, and an elastically compressible, laterally stable, planar honeycomb body having gas-filled cells, central axes of which are oriented normal to the plane of the planar honeycomb body, said honeycomb body being formed of a self-contained unit in which the cells of the honeycomb body are sealed at the periphery of the honeycomb body as well as at upper and lower honeycomb cell openings; wherein said honeycomb body is embedded in the cushioning sole layer so as to be encased thereby at only top and peripheral sides, the honeycomb body being visible from a bottom side of the sole and having a bottom wall through which the cells are endwise viewable.

18. Shoe sole according claim 17, wherein said shoe sole is a footbed for removable insertion within a shoe upper.

19. Shoe sole according to claim 17, wherein said shoe sole additionally comprises an outsole upon which said cushioning sole layer is mounted as a midsole, a window opening being provided in the outsole below a portion of the honeycomb body, and the honeycomb body being restrained against deflection through said window opening.

20. Shoe sole according to claim 19, wherein said midsole is in the form of a heel wedge.

21. Shoe sole according to claim 19, wherein said midsole comprises a midsole layer and a heel wedge layer, and wherein the honeycomb body is disposed in said heel wedge layer and the window opening also extends through said midsole layer.

22. Shoe sole according to claim 17, wherein said honeycomb insert is sealed so as to be substantially gastight.

23. Shoe sole according to claim 22, wherein the honeycomb body is sealed at each of opposite sides by a flexible sheet that overlies axial ends of the gas-filled cells.

* * * * *